US008973524B2

(12) United States Patent
Endo et al.

(10) Patent No.: US 8,973,524 B2
(45) Date of Patent: Mar. 10, 2015

(54) COMBINATORIAL SPIN DEPOSITION

(71) Applicant: Intermolecular, Inc., San Jose, CA (US)

(72) Inventors: Richard R. Endo, San Carlos, CA (US); Rajesh Kelekar, Los Altos, CA (US)

(73) Assignee: Intermolecular, Inc., San Jose, CA (US)

( * ) Notice: Subject to any disclaimer, the term of this patent is extended or adjusted under 35 U.S.C. 154(b) by 247 days.

(21) Appl. No.: 13/685,961

(22) Filed: Nov. 27, 2012

(65) Prior Publication Data

US 2014/0147587 A1 May 29, 2014

(51) Int. Cl.

| | |
|---|---|
| ***B05C 11/11*** | (2006.01) |
| ***B05C 11/115*** | (2006.01) |
| ***B05D 1/00*** | (2006.01) |
| ***B05D 1/32*** | (2006.01) |

(52) U.S. Cl.

CPC . *B05D 1/005* (2013.01); *B05D 1/32* (2013.01)

USPC ..... 118/504; 118/505; 118/52; 118/612

(58) Field of Classification Search

USPC ..... 118/504, 505, 301, 721, 52, 612, 319, 118/320, 56; 156/345.3, 345.19

See application file for complete search history.

(56) References Cited

U.S. PATENT DOCUMENTS

| | | | | |
|---|---|---|---|---|
| 5,376,408 | A | 12/1994 | Lippert | |
| 6,239,038 | B1 * | 5/2001 | Wen | 438/745 |
| 6,407,009 | B1 | 6/2002 | You et al. | |
| 6,992,024 | B2 | 1/2006 | Cui et al. | |
| 2009/0280235 | A1 * | 11/2009 | Lauerhaas et al. | 427/58 |

* cited by examiner

*Primary Examiner* — Yewebdar Tadesse

(57) ABSTRACT

A spin deposition apparatus includes a deposition mask configured to be arranged proximate a target substrate. The deposition mask includes at least one fluid reservoir offset from a rotational axis of the deposition mask and configured to hold fluid for dispersal on a portion of a surface of the target substrate.

9 Claims, 9 Drawing Sheets

COMBINATORIAL SPIN DEPOSITION

BACKGROUND

Generally, spin deposition is a procedure used to apply uniform thin films to substrates, for example, semiconductor substrates. Typically, an excess amount of a solution is placed on the substrate, which is then rotated at high velocity in order to spread the solution by centrifugal force.

The substrate is continually rotated while the fluid spins off edges of the substrate until a desired thickness of the film is achieved. The applied solution may contain a volatile solvent which evaporates during the deposition process. Overall thickness of the deposited film may thus depend on both angular velocity and volatility of the solvent as compared to the overall solution composition.

The solution may be applied using a nozzle, fan, jet, spray, or other form of application, and is generally positioned at a central portion of the substrate to enhance radial flow outward towards all edges of the substrate. It follows then, that an entire outer surface is conventionally coated, and as such, segmented regions or portions of a substrate are not easily coated without fouling or coating the remaining portions of a substrate.

SUMMARY

In some embodiments, a spin deposition apparatus includes a deposition mask configured to be arranged proximate a substrate. The deposition mask includes at least one fluid reservoir offset from a rotational axis of the deposition mask and configured to hold fluid for dispersal on a portion of a surface of the substrate.

In some embodiments, a spin deposition method includes accelerating a substrate and at least one fluid reservoir about a rotational axis until a desired target speed is reached. The at least one fluid reservoir is offset from the rotational axis. Upon reaching the target speed, the method further includes releasing fluid from the at least one reservoir onto a portion of a surface of the target substrate.

In some embodiments, a spin deposition method includes accelerating a substrate about a first axis of rotation until a first target speed is reached. Upon reaching the first target speed, the method further includes releasing fluid from a first fluid reservoir onto a first portion of a surface of the substrate. The method further includes accelerating the substrate about a second axis of rotation different than the first axis of rotation until a second target speed is reached. Additionally, upon reaching the second target speed, the method further includes releasing fluid from a second fluid reservoir onto a second portion of the surface of the substrate. The second portion is separate from the first portion of the surface of the substrate. These and further aspects of the invention are described more fully below.

DETAILED DESCRIPTION

Figure 1:
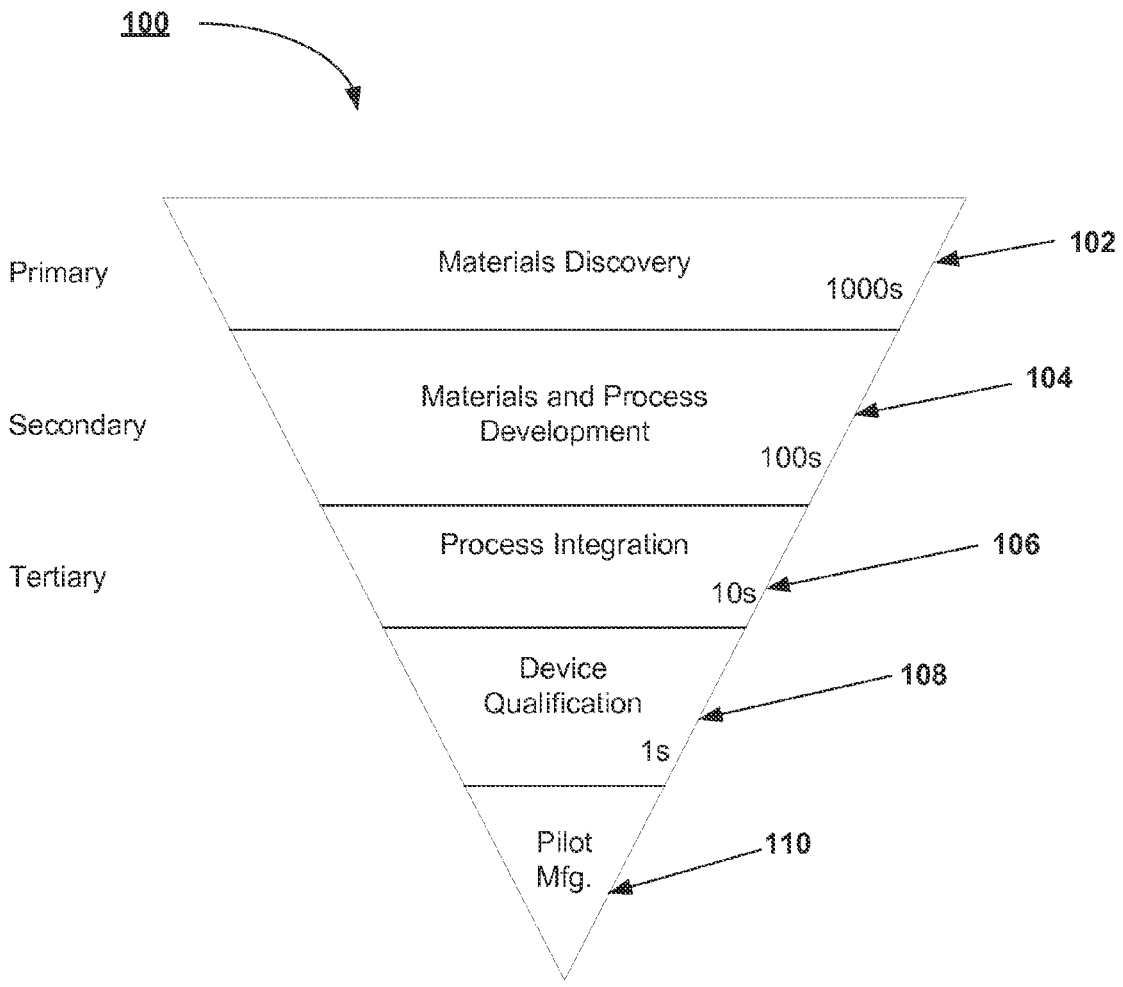
FIG. 1 illustrates a simplified schematic diagram providing an overview of the High-Productivity Combinatorial (HPC) screening process for use in evaluating materials, unit processes, and process sequences for the manufacturing of semiconductor devices in accordance with some embodiments.

The following description is provided as an enabling teaching of the invention and its best, currently known embodiments. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances, and are a part of the invention. Thus, the following description is provided as illustrative of the principles of the embodiments of the invention and not in limitation thereof, since the scope of the invention is defined by the claims.

It will be obvious, however, to one skilled in the art, that the embodiments described may be practiced without some or all of these specific details. In other instances, well known process operations have not been described in detail in order not to unnecessarily obscure the present invention.

The embodiments describe methods and apparatuses for combinatorial spin deposition where individual portions of a substrate may be subjected to spin deposition without coating remaining portions of the substrate. Thus, a plurality of different materials may be spin coated onto a single substrate individually or in combination to ascertain associated properties in a combinatorial manner. Accordingly, the embodiments described below may be integrated with combinatorial processing techniques described in more detail below.

Semiconductor manufacturing typically includes a series of processing steps such as cleaning, surface preparation, deposition, patterning, etching, thermal annealing, and other related unit processing steps. The precise sequencing and integration of the unit processing steps enables the formation of functional devices meeting desired performance metrics such as efficiency, power production, and reliability.

As part of the discovery, optimization and qualification of each unit process, it is desirable to be able to (i) test different materials, (ii) test different processing conditions within each unit process module, (iii) test different sequencing and integration of processing modules within an integrated processing tool, (iv) test different sequencing of processing tools in executing different process sequence integration flows, and combinations thereof in the manufacture of devices such as integrated circuits. In particular, there is a need to be able to test (i) more than one material, (ii) more than one processing condition, (iii) more than one sequence of processing conditions, (iv) more than one process sequence integration flow, and combinations thereof, collectively known as "combinatorial process sequence integration," on a single monolithic substrate without the need for consuming the equivalent number of monolithic substrates per materials, processing conditions, sequences of processing conditions, sequences of processes, and combinations thereof. This can greatly improve both the speed and reduce the costs associated with the discovery, implementation, optimization, and qualification of materials, processes, and process integration sequences required for manufacturing.

High Productivity Combinatorial (HPC) processing techniques have been successfully adapted to wet chemical processing such as etching and cleaning HPC processing techniques have also been successfully adapted to deposition processes such as physical vapor deposition (PVD), atomic layer deposition (ALD), and chemical vapor deposition (CVD).

Systems and methods for HPC processing are described in U.S. Pat. No. 7,544,574, filed on Feb. 10, 2006; U.S. Pat. No. 7,824,935, filed on Jul. 2, 2008; U.S. Pat. No. 7,871,928, filed on May 4, 2009; U.S. Pat. No. 7,902,063, filed on Feb. 10, 2006; and U.S. Pat. No. 7,947,531, filed on Aug. 28, 2009 each of which is incorporated by reference herein. Systems and methods for HPC processing are further described in U.S. patent application Ser. No. 11/352,077, filed on Feb. 10, 2006; U.S. patent application Ser. No. 11/419,174, filed on May 18, 2006; U.S. patent application Ser. No. 11/674,132, filed on Feb. 12, 2007; and U.S. patent application Ser. No. 11/674,137, filed on Feb. 12, 2007. The aforementioned patent applications claim priority from provisional patent application 60/725,186 filed Oct. 11, 2005. Each of the aforementioned patent applications and the provisional patent application are incorporated by reference herein.

FIG. 1 illustrates a schematic diagram 100 for implementing combinatorial processing and evaluation using primary, secondary, and tertiary screening. The schematic diagram 100 illustrates that the relative number of combinatorial processes run with a group of substrates decreases as certain materials and/or processes are selected. Generally, combinatorial processing includes performing a large number of processes during a primary screen, selecting promising candidates from those processes, performing the selected processing during a secondary screen, selecting promising candidates from the secondary screen for a tertiary screen, and so on. In addition, feedback from later stages to earlier stages can be used to refine the success criteria and provide better screening results.

For example, thousands of materials are evaluated during a materials discovery stage 102. Materials discovery stage 102 is also known as a primary screening stage performed using primary screening techniques. Primary screening techniques may include dividing substrates into coupons and depositing materials using varied processes. The materials are then evaluated, and promising candidates are advanced to the secondary screen, or materials and process development stage 104. Evaluation of the materials is performed using metrology tools such as electronic testers and imaging tools (e.g., microscopes).

The materials and process development stage 104 may evaluate hundreds of materials (i.e., a magnitude smaller than the primary stage) and may focus on the processes used to deposit or develop those materials. Promising materials and processes are again selected, and advanced to the tertiary screen or process integration stage 106 where tens of materials and/or processes and combinations are evaluated. The tertiary screen or process integration stage 106 may focus on integrating the selected processes and materials with other processes and materials.

The most promising materials and processes from the tertiary screen are advanced to device qualification 108. In device qualification, the materials and processes selected are evaluated for high volume manufacturing, which normally is conducted on full substrates within production tools, but need not be conducted in such a manner. The results are evaluated to determine the efficacy of the selected materials and processes. If successful, the use of the screened materials and processes can proceed to pilot manufacturing 110.

The schematic diagram 100 is an example of various techniques that may be used to evaluate and select materials and processes for the development of new materials and processes. The descriptions of primary, secondary, etc. screening and the various stages 102-110 are arbitrary and the stages may overlap, occur out of sequence, be described and be performed in many other ways.

This application benefits from High Productivity Combinatorial (HPC) techniques described in U.S. patent application Ser. No. 11/674,137, filed on Feb. 12, 2007, which is hereby incorporated by reference in its entirety. Portions of the '137 application have been reproduced below to enhance the understanding of the embodiments disclosed herein. The embodiments disclosed enable the application of combinatorial techniques to process sequence integration in order to arrive at a globally optimal sequence of semiconductor manufacturing operations by considering interaction effects between the unit manufacturing operations, the process conditions used to effect such unit manufacturing operations, hardware details used during the processing, as well as material characteristics of components utilized within the unit manufacturing operations. Rather than only considering a series of local optimums, i.e., where the best conditions and materials for each manufacturing unit operation is considered in isolation, the embodiments described below consider effects of interactions introduced due to the multitude of processing operations that are performed and the order in which such multitude of processing operations are performed when fabricating a device. A global optimum sequence order is therefore derived, and as part of this derivation, the unit processes, unit process parameters, and materials used in the unit process operations of the optimum sequence order are also considered.

The embodiments described further analyze a portion or sub-set of the overall process sequence used to manufacture a semiconductor device. Once the subset of the process sequence is identified for analysis, combinatorial process sequence integration testing is performed to optimize the materials, unit processes, hardware details, and process sequence used to build that portion of the device or structure. During the processing of some embodiments described herein, structures are formed on the processed substrate that are equivalent to the structures formed during actual production of the semiconductor device. For example, such structures may include, but would not be limited to, contact layers, buffer layers, absorber layers, or any other series of layers or unit processes that create an intermediate structure found on semiconductor devices. While the combinatorial processing varies certain materials, unit processes, hardware details, or process sequences, the composition or thickness of the layers or structures or the action of the unit process, such as cleaning, surface preparation, deposition, surface treatment, etc. is substantially uniform throughout each discrete region. Furthermore, while different materials or unit processes may be used for corresponding layers or steps in the formation of a structure in different regions of the substrate during the combinatorial processing, the application of each layer or use of a given unit process is substantially consistent or uniform throughout the different regions in which it is intentionally applied. Thus, the processing is uniform within a region (inter-region uniformity) and between regions (intra-region uniformity), as desired. It should be noted that the process can be varied between regions, for example, where a thickness of a layer is varied or a material may be varied between the regions, etc., as desired by the design of the experiment.

The result is a series of regions on the substrate that contain structures or unit process sequences that have been uniformly applied within that region and, as applicable, across different regions. This process uniformity allows comparison of the properties within and across the different regions such that the variations in test results are due to the varied parameters (e.g., materials, unit processes, unit process parameters, hardware details, or process sequences) and not the lack of process uniformity. In the embodiments described herein, the positions of the discrete regions on the substrate can be defined as needed, but are preferably systematized for ease of tooling and design of experimentation. In addition, the number, variants and location of structures within each region are designed to enable valid statistical analysis of the test results within each region and across regions to be performed.

Figure 2:
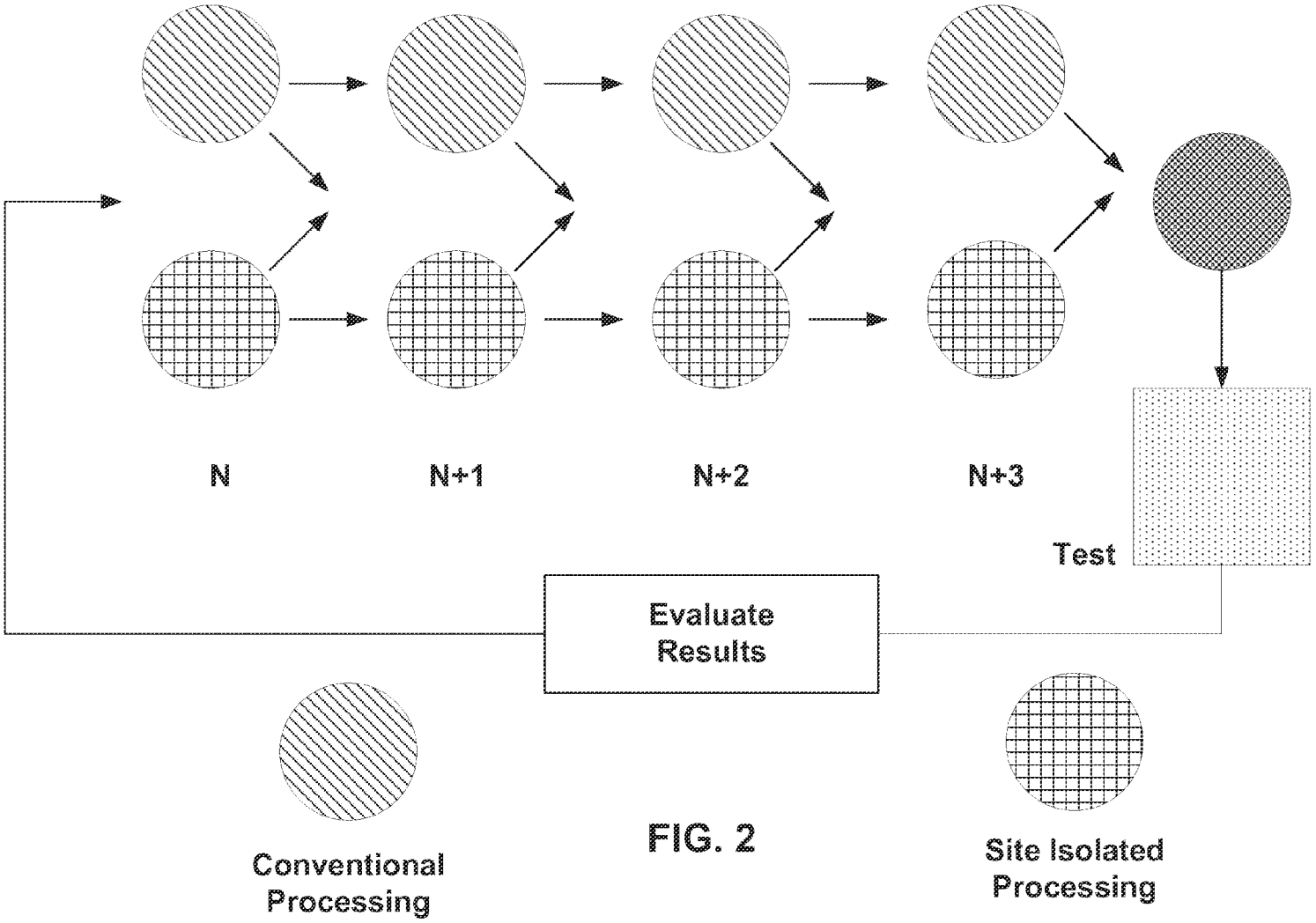
FIG. 2 illustrates a flowchart of a general methodology for combinatorial process sequence integration that includes site-isolated processing and/or conventional processing in accordance with some embodiments.

FIG. 2 is a simplified schematic diagram illustrating a general methodology for combinatorial process sequence integration that includes site isolated processing and/or conventional processing in accordance with one embodiment of the invention. In one embodiment, the substrate is initially processed using conventional process N. In one exemplary embodiment, the substrate is then processed using site isolated process N+1. During site isolated processing, an HPC module may be used, such as the HPC module described in U.S. patent application Ser. No. 11/352,077 filed on Feb. 10, 2006. The substrate can then be processed using site isolated process N+2, and thereafter processed using conventional process N+3. Testing is performed and the results are evaluated. The testing can include physical, chemical, acoustic, magnetic, electrical, optical, etc. tests. From this evaluation, a particular process from the various site isolated processes (e.g., from steps N+1 and N+2) may be selected and fixed so that additional combinatorial process sequence integration may be performed using site isolated processing for either process N or N+3. For example, a next process sequence can include processing the substrate using site isolated process N, conventional processing for processes N+1, N+2, and N+3, with testing performed thereafter.

It should be appreciated that various other combinations of conventional and combinatorial processes can be included in the processing sequence with regard to FIG. 2. That is, the combinatorial process sequence integration can be applied to any desired segments and/or portions of an overall process flow. Characterization, including physical, chemical, acoustic, magnetic, electrical, optical, etc. testing, can be performed after each process operation, and/or series of process operations within the process flow as desired. The feedback provided by the testing is used to select certain materials, processes, process conditions, and process sequences and eliminate others. Furthermore, the above flows can be applied to entire monolithic substrates, or portions of monolithic substrates such as coupons.

Under combinatorial processing operations the processing conditions at different regions can be controlled independently. Consequently, process material amounts, reactant species, processing temperatures, processing times, processing pressures, processing flow rates, processing powers, processing reagent compositions, the rates at which the reactions are quenched, deposition order of process materials, process sequence steps, hardware details, etc., can be varied from region to region on the substrate. Thus, for example, when exploring materials, a processing material delivered to a first and second region can be the same or different. If the processing material delivered to the first region is the same as the processing material delivered to the second region, this processing material can be offered to the first and second regions on the substrate at different concentrations. In addition, the material can be deposited under different processing parameters. Parameters which can be varied include, but are not limited to, process material amounts, reactant species, processing temperatures, processing times, processing pressures, processing flow rates, processing powers, processing reagent compositions, the rates at which the reactions are quenched, atmospheres in which the processes are conducted, an order in which materials are deposited, hardware details of the gas distribution assembly, etc. It should be appreciated that these process parameters are exemplary and not meant to be an exhaustive list as other process parameters commonly used in semiconductor manufacturing may be varied.

As mentioned above, within a region, the process conditions are substantially uniform, in contrast to gradient processing techniques which rely on the inherent non-uniformity of the material deposition. That is, the embodiments described herein perform the processing locally in a conventional manner, i.e., substantially consistent and substantially uniform, while globally over the substrate, the materials, processes, and process sequences may vary. Thus, the testing will find optimums without interference from process variation differences between processes that are meant to be the same. It should be appreciated that a region may be adjacent to another region in one embodiment or the regions may be isolated and, therefore, non-overlapping. When the regions are adjacent, there may be a slight overlap wherein the materials or precise process interactions are not known, however, a portion of the regions, normally at least 50% or more of the area, is uniform and all testing occurs within that region. Further, the potential overlap is only allowed with material of processes that will not adversely affect the result of the tests. Both types of regions are referred to herein as regions or discrete regions.

Figure 3:
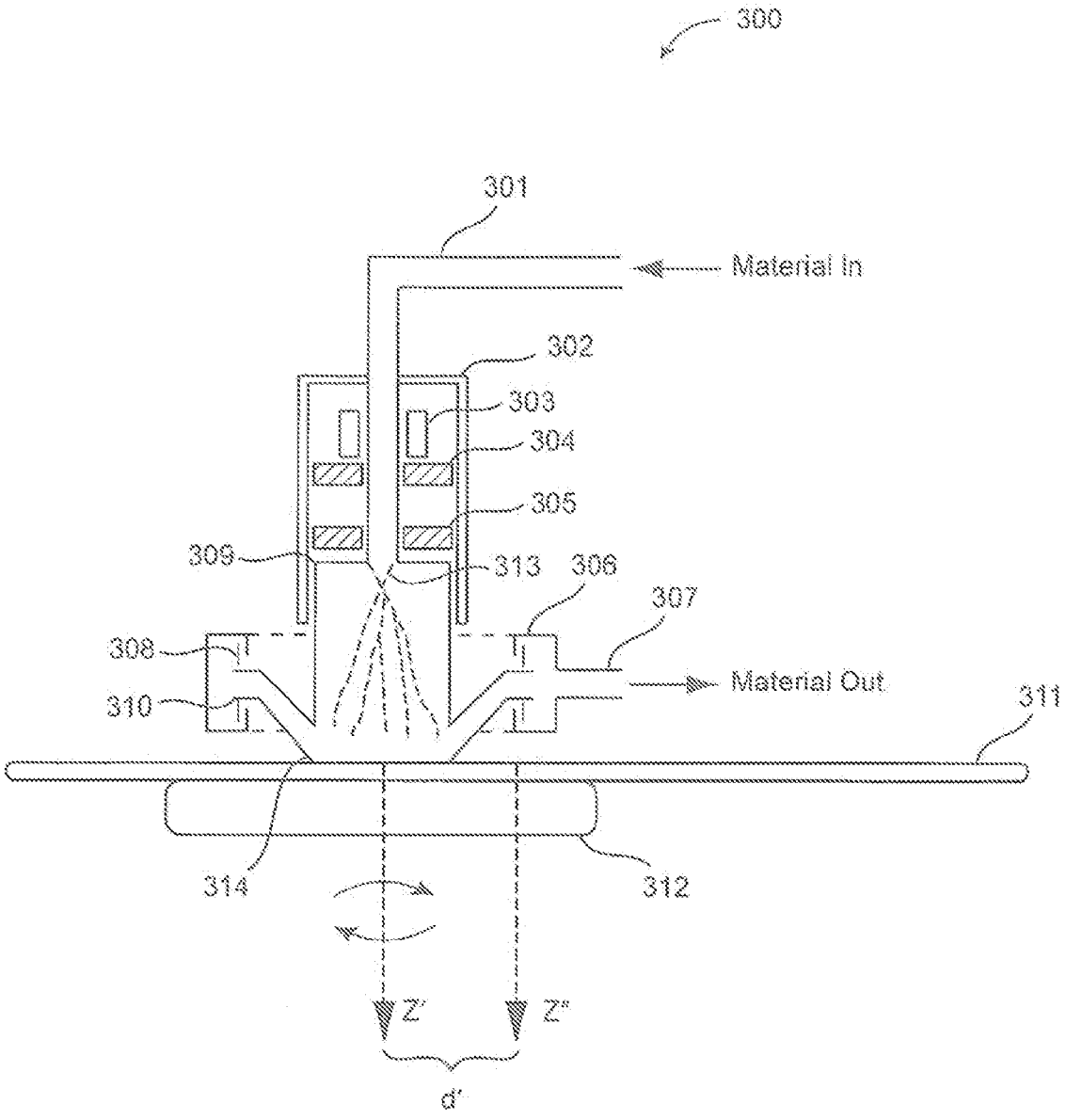
FIG. 3 illustrates a combinatorial spin deposition apparatus, according to some embodiments.

As stated above, under combinatorial processing operations the processing conditions at different regions can be controlled independently. According to some embodiments of the present invention, individual apparatuses for spin deposition onto different regions absent coating of remaining regions are provided. For example, turning to FIG. 3, a combinatorial spin deposition apparatus is illustrated.

As illustrated, the apparatus 300 includes a fluid inlet 301. The fluid inlet 301 is configured to transmit a predetermined or desired amount of a material in a liquid phase, a material suspended in solvent, or any suitable liquid solution. The apparatus 300 further includes an outer cylindrical housing 302 coupled to the fluid inlet 301. The outer cylindrical housing 302 may be arranged to house a plurality of components, including rotary seal 303, rotation bushings 304 and 305, and inner cylindrical nozzle 309.

Rotary seal 303 may be a generally cylindrical seal arranged to allow fluid communication between the fluid inlet 301 (which may be stationary) and inner cylindrical nozzle 309 (which may be rotated). Rotary seal 303 may be embodied as any suitable seal, including metallic, plastic, elastomeric, or other desirable seals.

Rotation bushings 304 and 305 may be bushings allowing for the rotation of the inner cylindrical nozzle 309 relative to the outer cylindrical housing 302. As such, rotation bushings 304 and 309 may be generally cylindrical constructs of a material allowing for said rotation.

Inner cylindrical nozzle 309 may be a generally bell-shaped housing having inverted bell exhaust formation 310 extending radially therefrom. The inverted bell exhaust formation 310 surrounds an exterior of the inner cylindrical nozzle 309 and allows for removal of excess fluid deposited on a substrate 311.

The inverted bell exhaust formation 310 may be coupled to toroidal exhaust member 306 such that the excess fluid received from the inverted bell exhaust formation 310 may be removed through fluid outlet 307. Generally, the inverted bell exhaust formation 310 may be configured to rotate within the toroidal exhaust member 306 and may be coupled thereto, or supported therefrom, with mechanical seals 308. Mechanical seals 308 may be any suitable seals, including generally cylindrical or annular seals allowing for the rotation and exhaust noted above.

As stated above, the inner cylindrical nozzle 309 may be configured to rotate relative to the outer cylindrical housing 302 while depositing fluid/material on substrate 311. The axis of rotation Z' of the inner cylindrical housing 309 may be defined by an axis of rotation of a chuck or mechanical support 312 supporting the substrate 311. For example, the chuck 312 may be any suitable chuck allowing for rotation of a substrate coupled thereto, including a vacuum chuck or other mechanical chuck.

Although conventional spin deposition methods require a central axis of a substrate (denoted as Z") to match a rotational axis of a mechanical chuck (denoted as Z'), exemplary embodiments are not so limited. For example, due to the exhaust formation 310 allowing for removal of excess material to toroidal exhaust member 306, the central axis Z" of the substrate 311 may be allowed to travel along any arcuate segment defined by the axis Z' and the distance d' between the axes Z' and Z" (e.g., the azimuth). More clearly, the exhaust formation 310 forms an active peripheral annular seal about an outer portion of the inner cylindrical nozzle 309 which removes excess material before coating the remaining exterior surface of the substrate 311. Therefore, the rotational axis Z' of the substrate 311, chuck 312, and apparatus 300 can be moved relative to the axis Z" such that individual regions of uniformly spin coated substrate may be formed without interference therebetween. It follows then that a plurality of materials may be deposited onto the substrate 311 in a combinatorial manner by which research and development of new materials may be accelerated while reducing costly waste of available substrate surface.

Figure 4A:
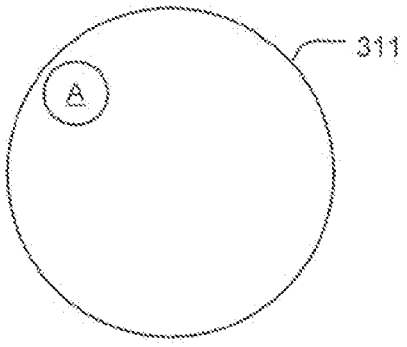
FIGS. 4A-4B illustrate a portion of a method of combinatorial spin deposition, according to some embodiments.
Figure 4B:
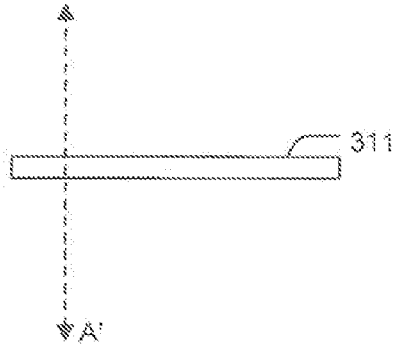
Figure 5A:
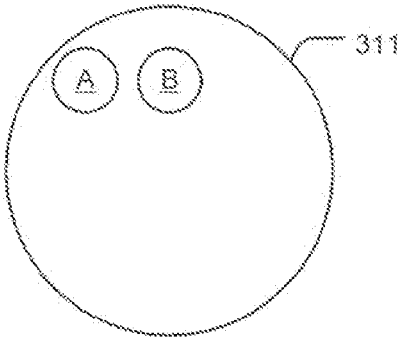
FIGS. 5A-5B illustrate a portion of a method of combinatorial spin deposition, according to some embodiments.
Figure 5B:
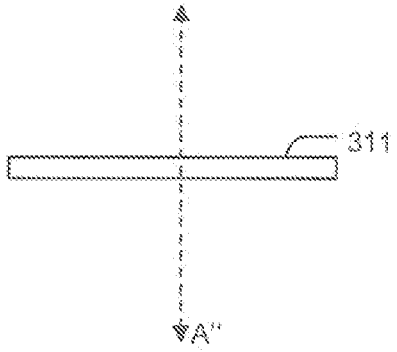
Figure 6A:
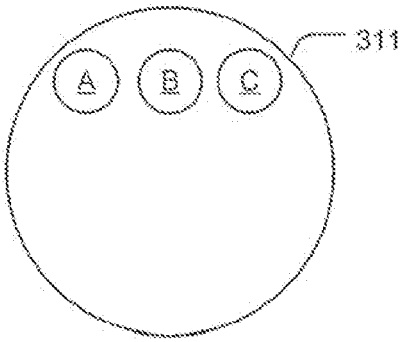
FIGS. 6A-6B illustrate a portion of a method of combinatorial spin deposition, according to some embodiments.
Figure 6B:
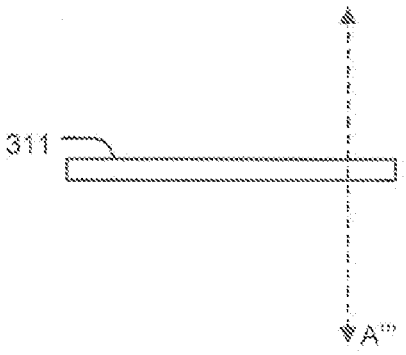
Figure 7:
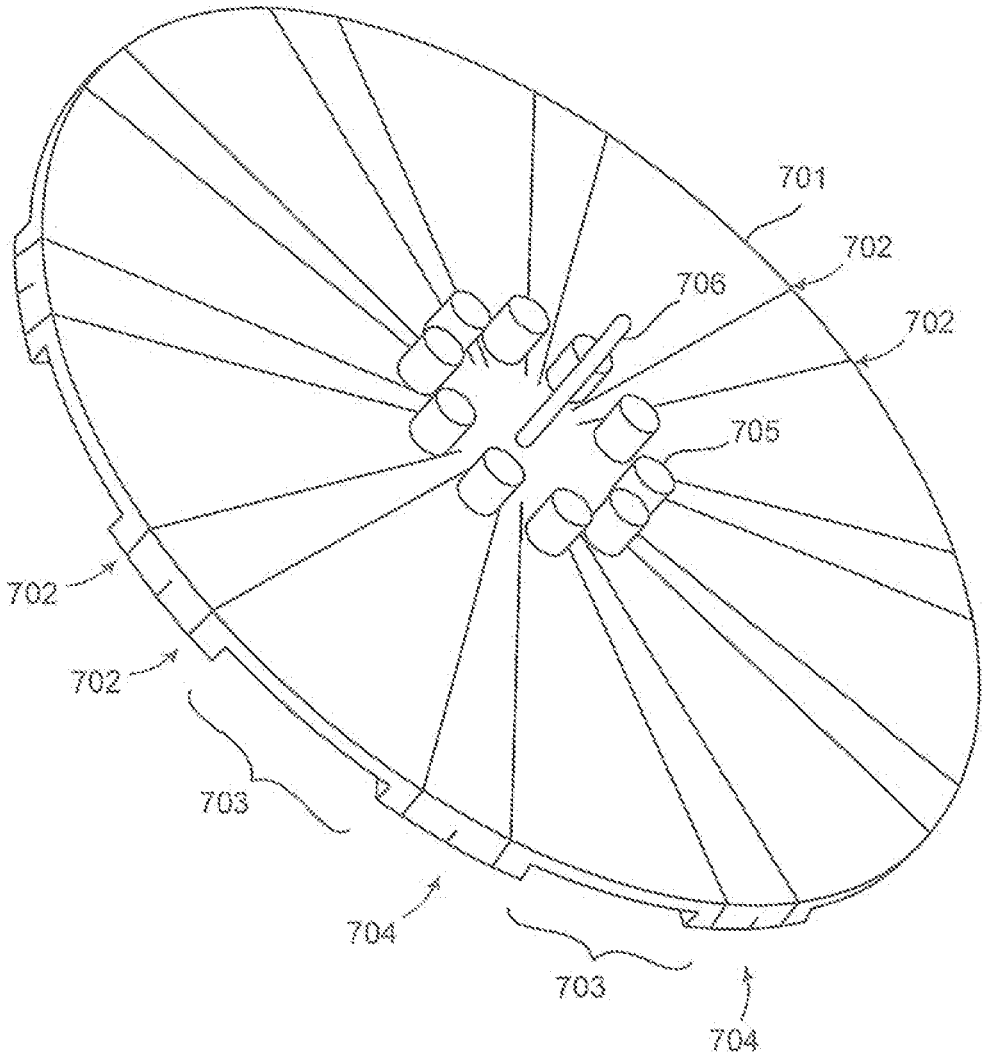
FIG. 7 illustrates a top perspective view of a combinatorial spin deposition apparatus, according to some embodiments.
Figure 8:
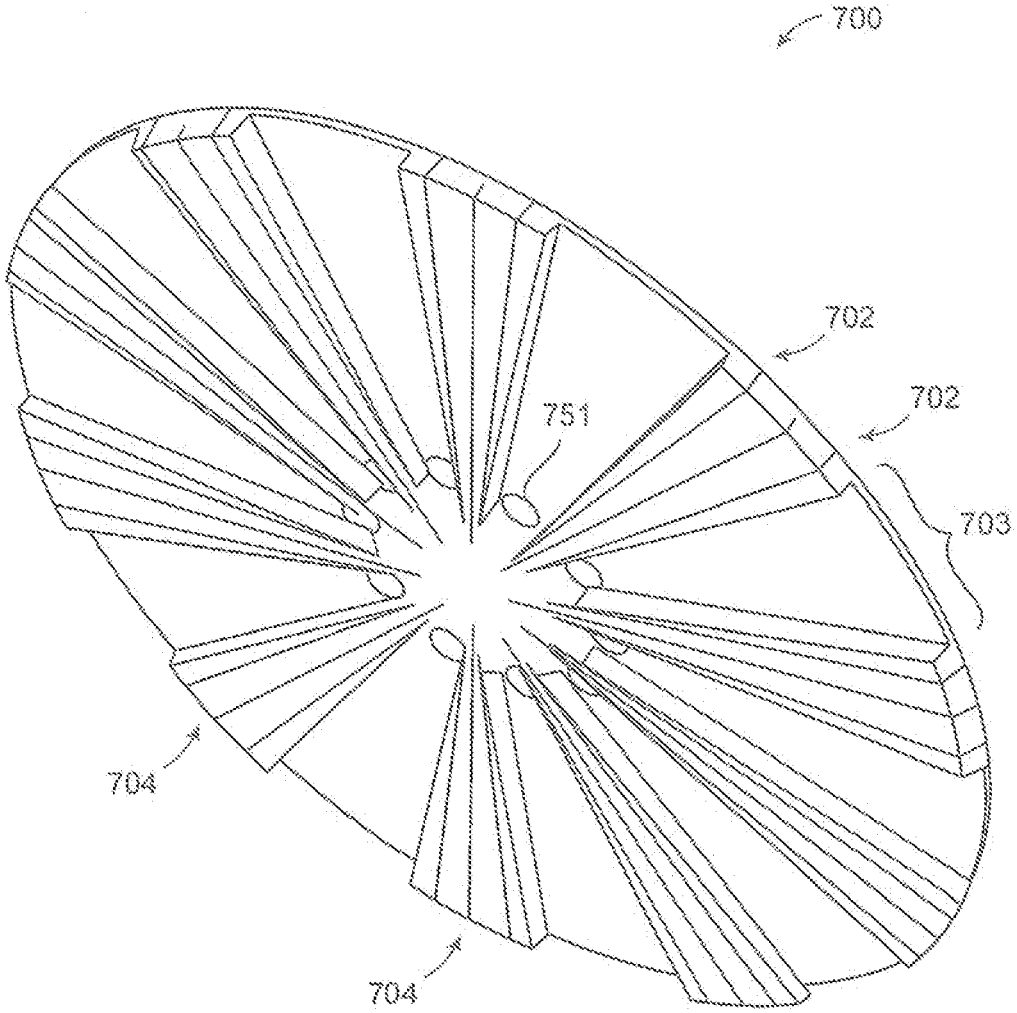
FIG. 8 illustrates a bottom perspective view of a combinatorial spin deposition apparatus, according to some embodiments.
Figure 9:
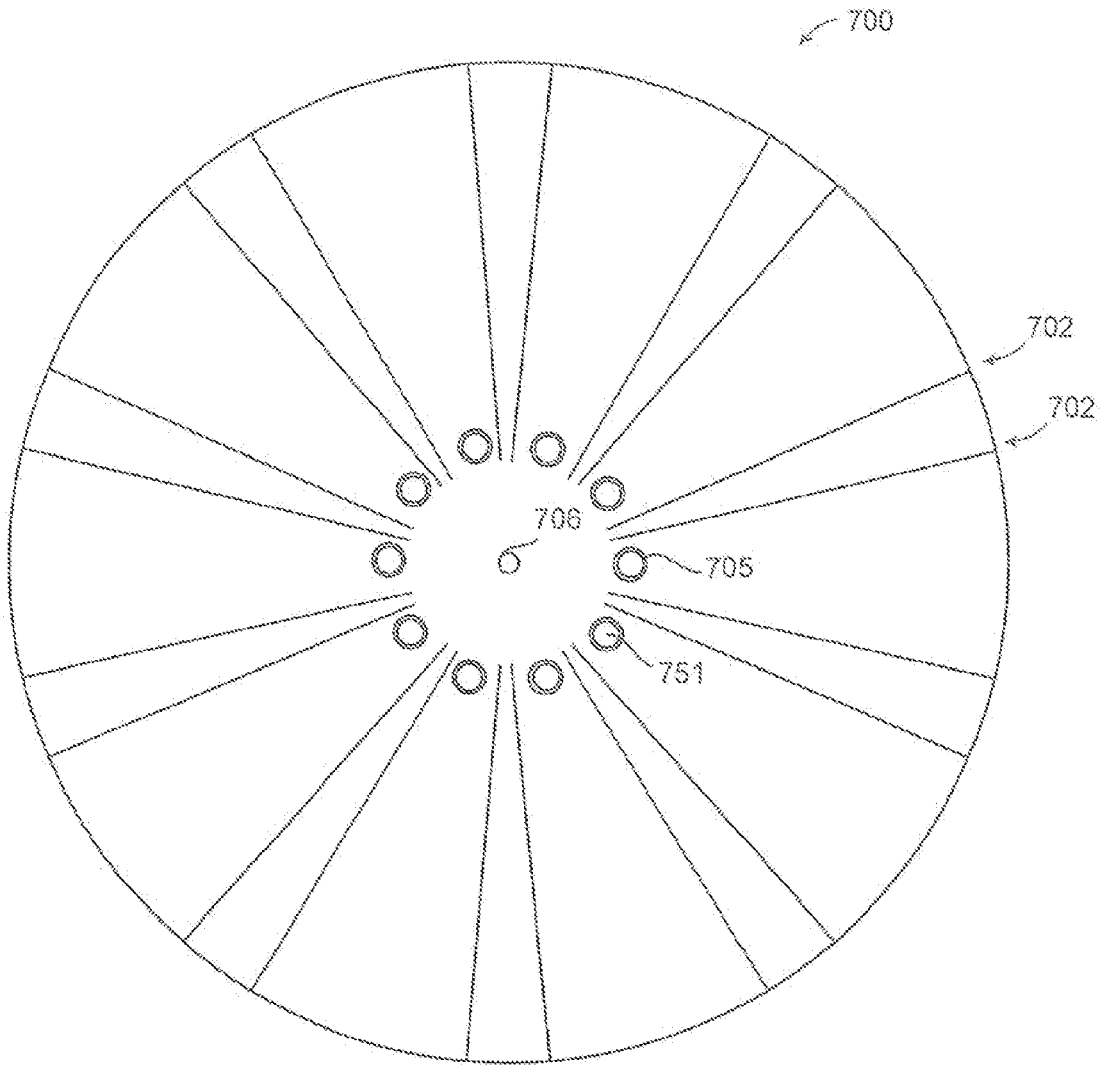
FIG. 9 illustrates a top-down view of a combinatorial spin deposition apparatus, according to some embodiments.
Figure 10:
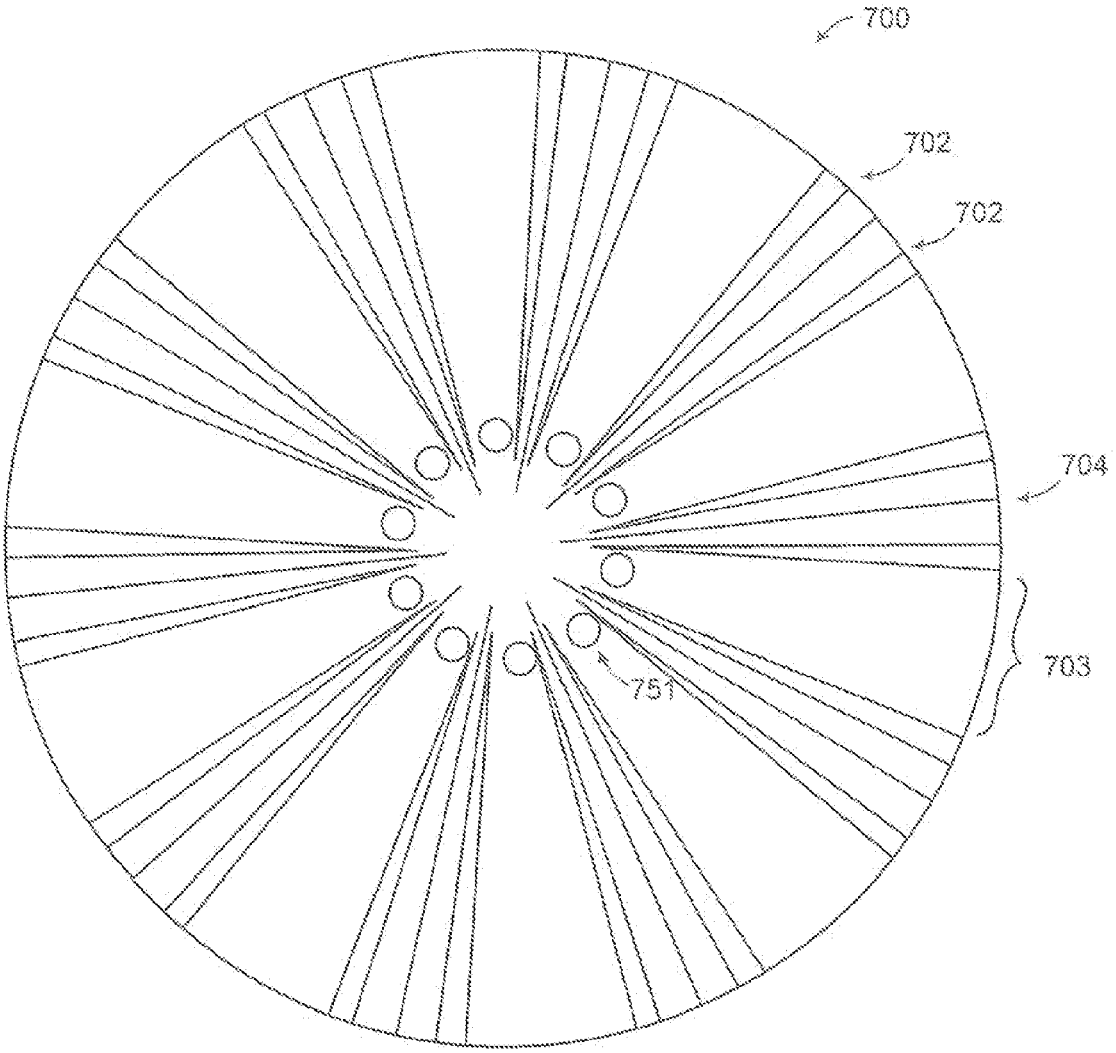
FIG. 10 illustrates a bottom-up view of a combinatorial spin deposition apparatus, according to some embodiments.
Figure 11:
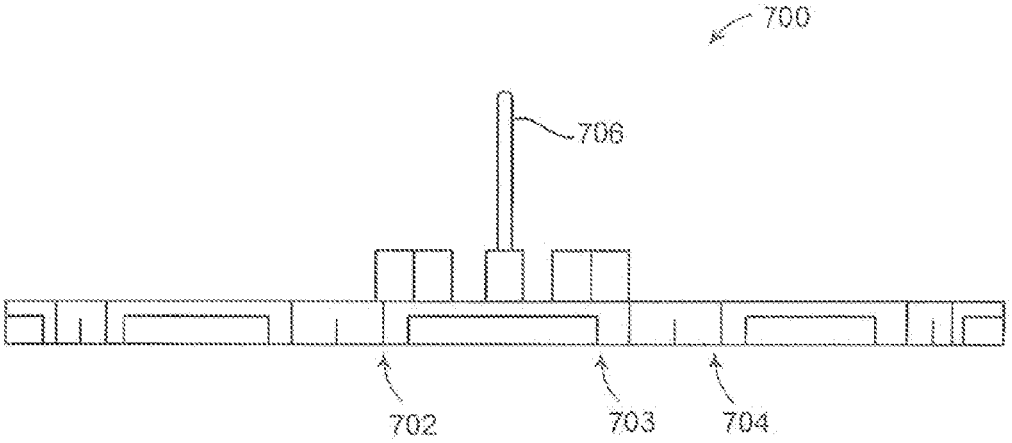
FIG. 11 illustrates an elevation view of a combinatorial spin deposition apparatus, according to some embodiments.

For example, FIGS. 4A, 4B, 5A, 5B, 6A and 6B illustrate a method of combinatorial spin deposition which may use the apparatus 300. As shown in FIGS. 4A and 4B, the method includes accelerating (e.g., spinning) a substrate 311 about a first axis of rotation A' until a desired target speed is reached. Upon reaching the target speed, a first reservoir of fluid is released onto region A of the substrate 311. The fluid in the reservoir may be passed through, for example, fluid inlet 301 and inner cylindrical nozzle 309. Excess fluid is removed through the exhaust formation 310 and exhaust member 306 such that uniformly coated region A is formed. Thereafter, the target substrate 311 is accelerated about a second axis of rotation A", different than the first axis of rotation A', until a desired target speed is reached. Upon reaching the second target speed which may be the same or different as the first target speed, a second reservoir of fluid is released onto region B of the substrate 311. The fluid in the second reservoir may again be passed through, for example, fluid inlet 301 and inner cylindrical nozzle 309. Excess fluid is removed through the exhaust formation 310 and exhaust member 306 such that uniformly coated region B is formed.

The same may be repeated to form uniformly coated region C through rotation about axis A'" different than axes A' and A". As illustrated, the differing axes of rotation allow deposition of material onto different regions A, B, and C of the surface of the target substrate 311 in thin films. In this manner, different isolated, but uniformly coated, regions may be formed, tested, or otherwise analyzed in a combinatorial fashion as described above.

Although described above as relating to an apparatus with a single fluid inlet or reservoir for rotation about several different axes of rotation, it should be understood that the same may be varied in many ways. For example, FIGS. 7-11 illustrate a combinatorial spin deposition apparatus which may deposit one or more isolated or different thin films on a substrate using one or more axes of rotation.

As illustrated, spin deposition apparatus 700 includes a deposition mask 701 configured to mask a surface of a target substrate. The deposition mask 701 includes fluid reservoirs 705 radially offset from a central axis of the mask 701. The deposition mask 701 is configured to be placed proximate the surface of the target substrate. The fluid reservoirs 705 are configured to hold a predetermined or desired amount of a material in its liquid phase, a material suspended in solvent, or any suitable liquid solution.

The deposition mask 701 may also include radial seals 704 extending radially outward from an area proximate the central axis to a free edge of the deposition mask 701 defining arc segment regions 703. The radial seals 704 may be mechanical seals including a mechanical barrier applied to the surface of the target substrate. The radial seals 704 may also be physical seals including a dynamic pressure barrier applied to the surface of the substrate. The dynamic pressure barrier may be facilitated through application of a fluid through a central opening or cylindrical inlet 706 through to vents 702 proximate the radial seals 704. The fluid, e.g., a gas or liquid, acts upon the surface of the target substrate to reduce or eliminate travel of material expelled from the fluid reservoirs 705 across the seals 704 to adjacent arc segment regions. Excess gas/liquid is then released through an exterior surface of the mask 701 through the vents 702 and from the outer edge of the target substrate. The deposition mask 701 may be arranged to make physical contact with the target substrate, or may be suspended above the target substrate during use.

The fluid reservoirs 705 may each include a dynamically actuated valve system 751 (see FIGS. 8-10) configured to controllably release material contained therein. The valve system 751 may be mechanically actuated, electrically actuated, wirelessly actuated, or optically actuated. The mechanical actuation may be facilitated through application of mechanical force upon the valve system in some embodiments. The electrical actuation may be facilitated through application of an electrical signal to the valve system (e.g., magnetic actuation, solenoid, etc). The optical actuation may be facilitated through application of a light pulse or signal upon an optical receiver coupled to the valve system. The deposition apparatus 700 of FIGS. 7-11 may be used according to the combinatorial techniques described herein.

FIGS. 12A, 12B, 13A, and 13B illustrate an additional combinatorial spin deposition method, according to some embodiments. The spin deposition method may include accelerating (e.g., spinning) a substrate and individual fluid reservoirs (e.g., 705) about a central axis A' until a desired target speed is reached. The central axis A' may include the central axis of the target substrate, or it may be offset as described above. The acceleration of the individual fluid reservoirs ensures fluid in each reservoir is biased to flow radially outward from the central axis. Upon reaching the target speed, fluid is released from each individual reservoir. Each individual reservoir may be offset from the central axis of rotation A', and may be proximate an arc segment region sealed with radial seals as described above. Thus, fluid flows radially across the surface of the target substrate, thereby depositing a thin film in radial tracks, separate from one another, and applicable to any of the combinatorial techniques described above.

Figure 12A:
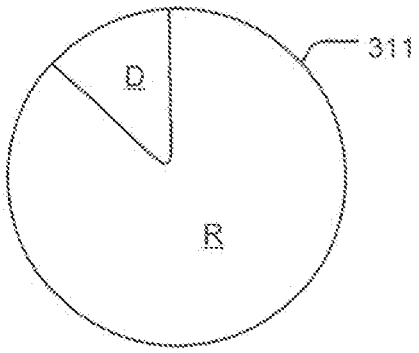
FIGS. 12A-12B illustrate a portion of a method of combinatorial spin deposition, according to some embodiments.
Figure 12B:
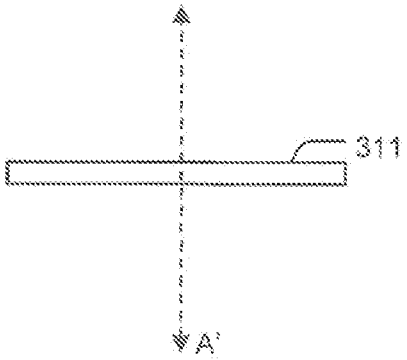
Figure 13A:
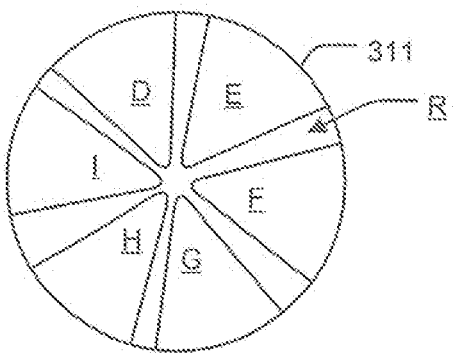
FIGS. 13A-13B illustrate a portion of a method of combinatorial spin deposition, according to some embodiments.
Figure 13B:
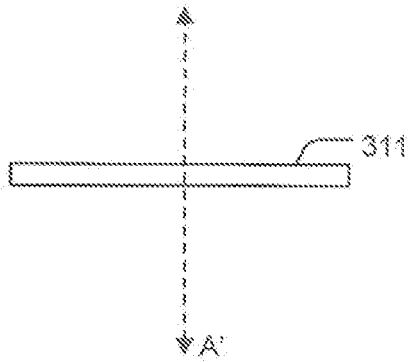

Fluid may be deposited in a single region D of a target substrate 311, as illustrated in FIG. 12A, leaving remaining portions R of the substrate 311 undisturbed. Alternatively, as illustrated in FIG. 13A, one or more regions D, E, F, G, H and I may be coated simultaneously, at substantially the same time, or in any desired sequence using a deposition mask somewhat similar to the mask 701.

When compared to existing methods and apparatuses, the embodiments described can provide rapid combinatorial processing techniques which increase productivity in research and development of new materials, coatings, and processing of semiconductor substrates and associated devices. The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the spirit and scope of the present invention. In addition, it is possible to use some of the features of the present invention without the corresponding use of the other features. Accordingly, the foregoing description of the exemplary embodiments is provided for the purpose of illustrating the principles of the present invention, and not in limitation thereof, since the scope of the present invention is defined solely by the appended claims.

What is claimed:

1. A spin deposition apparatus, comprising:

a deposition mask configured to be arranged proximate a substrate, the deposition mask comprising at least one fluid reservoir offset from a rotational axis of the deposition mask and configured to hold fluid for dispersal on a portion of a surface of the substrate, wherein the deposition mask further comprises at least one radial seal extending radially outward from an area proximate the rotational axis of the deposition mask to an edge of the deposition mask.

2. The apparatus of claim 1, wherein:

the at least one radial seal is a mechanical seal including a mechanical barrier applied to the surface of the substrate.

3. The apparatus of claim 1, wherein:

the at least one radial seal is a physical seal including a dynamic pressure barrier applied to the surface of the substrate.

4. The apparatus of claim 3, wherein the deposition mask further comprises:

at least one radial vent extending radially outward from an area proximate the rotational axis of the deposition mask to an edge of the deposition mask.

5. The apparatus of claim 4, wherein:

the dynamic pressure barrier is facilitated through application of a gas or liquid through the at least one radial vent.

6. The apparatus of claim 5, wherein:

the dynamic pressure barrier acts upon the surface of the substrate to contain travel of material expelled from the fluid reservoir.

7. The apparatus of claim 1, wherein the deposition mask further comprises:

a plurality of fluid reservoirs offset from the rotational axis of the deposition mask and configured to hold fluid for dispersal on separate regions of the surface of the substrate.

8. The apparatus of claim 7, wherein the separate regions are each arc segment regions extending radially outward from each fluid reservoir of the plurality of fluid reservoirs.

9. The apparatus of claim 7, wherein the deposition mask further comprises:

a plurality of radial seals extending radially outward from an area proximate the rotational axis of the deposition mask to an edge of the deposition mask, wherein each radial seal of the plurality of radial seals defines a boundary of individual regions of the separate regions of the surface of the substrate.

* * * * *